United States Patent [19]

Takai

[11] 4,009,811

[45] Mar. 1, 1977

[54] VENTS-MAKING DISPENSER CARTON

[76] Inventor: Hiromitsu Takai, Building, 4-12 3-chome, Rm. 202 Daiichi Takai, Shimbashi Minato, Tokyo 105, Japan

[22] Filed: Mar. 10, 1975

[21] Appl. No.: 556,936

[52] U.S. Cl. ..... 225/7; 83/599; 83/649; 225/48

[51] Int. Cl.[2] ..... B26F 1/00; B26F 3/02

[58] Field of Search ..... 225/7, 39, 48, 49, 50, 225/77, 88, 91; 83/2, 30, 599, 660, 684, 685, 691, 695, 649

[56] References Cited

UNITED STATES PATENTS

| | | | |
|---|---|---|---|
| 962,913 | 6/1910 | Palmer | 83/599 X |
| 2,463,514 | 3/1949 | Bucky | 225/7 |
| 2,925,207 | 2/1960 | Kunsch | 225/7 |
| 3,088,640 | 5/1963 | Kunsch | 225/91 X |
| 3,118,581 | 1/1964 | Finke | 225/48 X |
| 3,123,266 | 3/1964 | Jernigan | 225/48 |
| 3,799,417 | 3/1974 | Williams | 225/7 |

*Primary Examiner*—Frank T. Yost
*Attorney, Agent, or Firm*—J. Gibson Semmes

[57] ABSTRACT

The present invention relates to a dispenser carton for accommodating a roll of aluminum foil or the like, and more particularly to a dispenser carton with a new function, by which numerous aligned vents can be made on the foil at the same time simply by a simple and safe operation, namely, through the motion of projections provided on the reverse side of the dispenser carton cover by closing and opening the cover thereof.

8 Claims, 11 Drawing Figures

VENTS-MAKING DISPENSER CARTON

Normally, the plain aluminum foil, etc. are accommodated, respectively, in a fully-wound shape inside the dispenser carton. However, due to absence of permeability in the plain foil, the tastes of the foil-covered food may often degrade because of moisture trapped inside the foil during the cooking operation of the foil-covered dishes of food, bowls of food, etc. Accordingly, the foil with vents on the bottom thereof is required in roasting, for example, turkeys, chicken, beef, ham. Also, it is desirable to use the foil with vents provided thereon in such cases where the food is desired to be cooked quickly or to be cooled faster. It is inconvenient to use the plain foil in such cases. It is required to use the new foil with vents provided thereon.

It is a first object of the present invention to provide a dispenser carton which is capable of producing completely new vents foil, by use of the usual plain foil, easily and safely through the operation of the projections and a perforated plate simply by closing and opening the cover of the dispenser carton.

It is a second object of the present invention to provide a dispenser carton having a completely new function, with the conventional dispenser carton remaining the same in appearance.

It is a third object of the present invention to provide a dispenser carton which is capable of making the neatly-aligned vents at the same time. It is constructed such that the small vents are made when the cover with conical, triangular or the like projections mounted thereon has been pressed lightly, while the larger vents are made when the cover therewith has been pressed strongly.

It is a fourth object of the present invention to provide a dispenser carton which is capable of freely making, on the foil, the vents each having a length as required in a desired location.

It is a fifth object of the present invention to provide a dispenser carton which can use the plain foil as it is if desired.

It is a sixth object of the present invention to provide a dispenser carton which allows refilling of the foil, and besides can cut the foil when necessary.

These objects are accomplished by each portion constituting the present invention, improvements, combination thereof and operation thereof. The embodiment thereof will be illustrated in the following detailed description with reference to the accompanying drawings.

Modifications and variations concerning the details of the structure of the present invention will be included in the scope of the claim which is described later.

According to the present invention, numerous projections are mounted on the reverse side of the cover of the elongated dispenser carton, and a plate having numerous small holes thereon into which the numerous projections are correspondingly engaged is fitted into an opening portion. The projections go up and down by opening and closing the cover thereof. When the cover has been depressed, the projections thereof are adapted to engage into the small holes on the plate which is fitted into the opening portion, so that the vents are made on the foil. When the cover is not closed, the plain foil can be withdrawn.

FIG. 1 is a perspective view showing a vents-making dispenser carton of the present invention, the cover thereof being open to show the interior thereof in a dotted line.

FIGS. 2*a–c* inclusive are enlarged views of the various projection plates for the vents-making dispenser carton together with corresponding puncture plates FIGS. 2*a*1–2*c*1 inclusive and FIG. 2*d* illustrates a spongeous plate modification.

Figure 1:
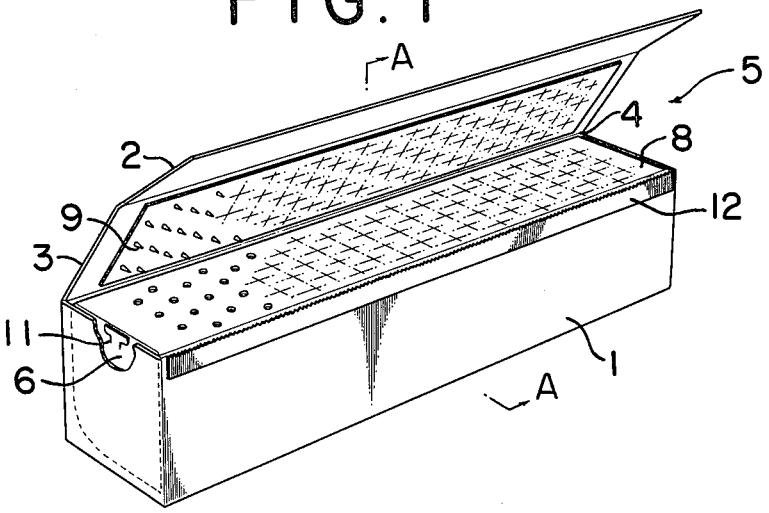

According to the vents-making dispenser carton of the present invention, as shown in FIG. 1, a carton body 1 for accommodating the foil has an elongated cover 3 connected thereto, the cover having a claw 2 connected to one side thereof. An opening portion 5 for the carton is provided in the forward portion of the carton from the crease 4 of the cover 3. The cover 3 can be closed and opened easily by a single hand and is so dimensioned as to cover the opening portion 5.

Support plates 6 and 6 for maintaining the height of the carton are provided, respectively, at both ends thereof, and are connected, on the side opposite to the cover 3 of the opening portion 5, to the carton body 1. A perforated plate 8 has an elongated reinforcement plate 7 connected to the tip end thereof for maintaining the horizontal posture of the perforated plate. The perforated plate 8 is bent inwardly. The support plates 6 and 6, and the reinforcement plate 7 are also inserted inwardly for the horizontal closure of the opening portion 5. Numerous projections 9 each having such same optional shape as shown in FIG. 2 are mounted on the reverse side of the cover 3 to make the vents on the foil. The projections 9 are conical or triangular or the like in shape respectively and are made of a rugged material such as synthetic plastic, metal sheet, etc. They are mounted on the reverse side of the cover 3. The tip ends of the projections 9 are adapted to be directed downwardly when the opening portion 5 has been covered by closing the cover 3.

Figure 2A:
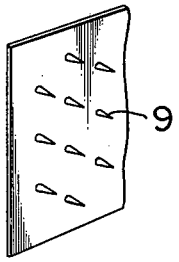
Figure 2B:
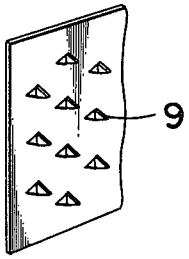
Figure 2C:
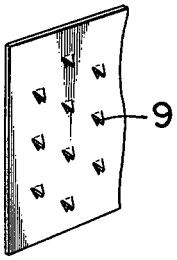
Figure 2C:
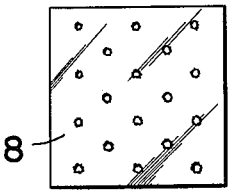
Figure 2C:
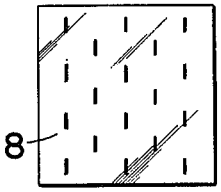
Figure 2C:
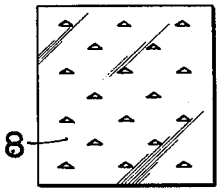
Figure 2D:
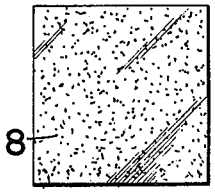

The projections 9 produce round vents when they are, respectively, of conical shape, and numerous small rent-like vents, or normally-erected or invertedly-erected small triangle-like vents as shown in FIG. 2*a*, 2*b*, 2*c*, according to the respective shapes of the projections 9 when the respective triangle shapes of the projections have been arranged longitudinally, although the forms of the vents depend upon the respective arranged direction of the triangles. These projections 9 are conical or triangular in shape and are tapered. Accordingly, small vents are produced when the foil has been depressed lightly by the projections 9, while large vents are produced when the foil has been depressed strongly and deeply thereby. As shown in FIGS. 2*a*1, 2*b*1, 2*c*1 and FIG. 3, the perforated plate 8 has numerous small holes 10 thereon, respectively, of the same optional shape, and the small holes are provided in the same arrangement as the projections are so that the numerous projections 9 may be correspondingly engaged into the numerous small holes.

The perforated plate 8 is fitted into the opening portion 5 with a slight opening remaining between the crease 4 of the cover 3 and the plate 8, so that the foil may pass therethrough.

The support plates 6 and 6 are mounted at both ends of the carton to retain the same height as that of the opening portion 5 after the perforated plate 8 has been engaged into the opening portion 5. An elongated reinforcement plate 7 is provided at the tip end of the plate 8 to retain the top face of the perforated plate 8 horizontally so that the plate may not sink. These support plates 6 and 6, and the reinforcement plate 7 are both inserted into the carton body 1, and the perforated plate 8 is engaged into the opening portion 5.

T-shaped pieces 11 and 11 are mounted, respectively, on the middle portions of the creases of the support plates 6 and 6. The T-shaped piece becomes convenient in opening the engaged perforated-plate 8 by catching it with fingers.

In order to accommodate the roll of foil inside the carton, the roll of foil is placed inside the carton, and the leading end of the fully-wound foil is withdrawn along the cover 3. When the perforated plate 8 is inserted into the opening portion, the leading end of the foil is already withdrawn from between the crease 4 of the cover 3 and the perforated plate 8 so that the foil may be placed on the perforated plate 8.

Figure 4:
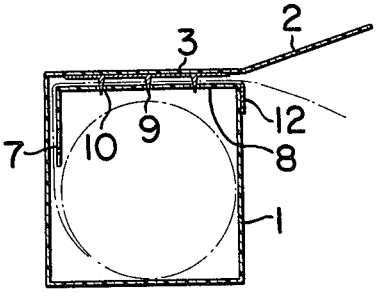
FIG. 4 is a cross-sectional view taking along line A—A of FIG. 1 in a condition where the foil is depressed by the cover, the foil being indicated in a dotted line.
Figure 3:
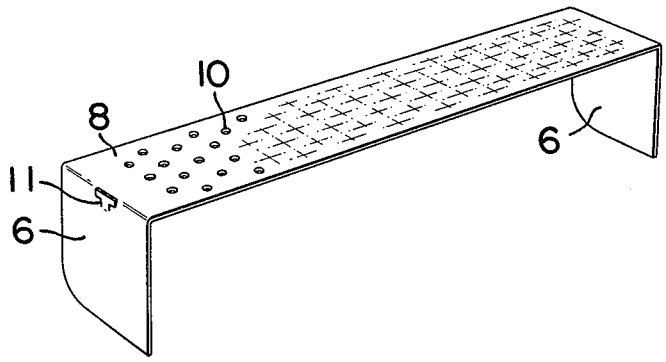
FIG. 3 is a perspective view showing a perforated plate for the vents-making dispenser carton of the present invention.

Since the dispenser portion is of such character as described hereinabove, the withdrawn foil which has been placed on the perforated plate 8 is kept level without sinking as shown in FIG. 4. Accordingly, when the foil has been depressed by the cover 3, the projections 9 mounted on the reverse side of the cover 3 penetrate through the foil with their tip ends being directed downwardly, and are engaged into the small holes 10 on the perforated plate 8. However, neatlooking aligned vents are provided easily on the foil at the same time by opening the cover 3.

The withdrawn foil is cut away by means of an elongated saw cutting blade, which is mounted in the opening portion 5 of the carton, on the exterior side of the crease of the perforated plate 8, or on the bottom of the carton.

Since the dispenser carton is of such characters as described hereinabove, not only the aluminum foil, but also plastic wrapping film, roll paper, etc. can be used, in completely same manner as described hereinabove, in the present dispenser carton. Ladies and children can make vents easily and safely. The ventsfoil, which has been made by the vents-making dispenser carton of the present invention, improves our life furthermore.

Figure 5:
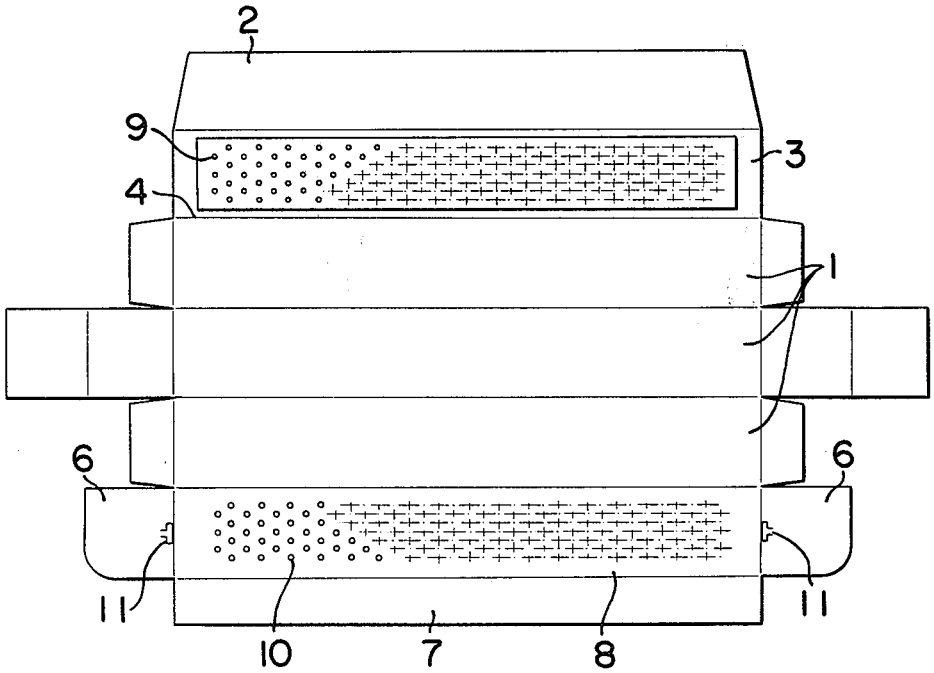
FIG. 5 is a developed view of the vents-making dispenser carton of the present invention.

The present invention can provide a great number of dispenser cartons inexpensively, since the box manufacturing operation can be effected by means of an auto-box-manufacturing machine if the dispenser carton is already formed from one piece of thick paper as shown in FIG. 5. However, as the case may be, the perforated plate 8 can be made separately from the carton body 1. Later, the plate 8 can be inserted into the opening portion 5. In this case, it is necessary for the reinforcement plate 7 to be mounted, respectively, in the front end and the rear end of the perforated plate 8. Also, the projections 9 can be mounted on the side of the opening portion 5, while the perforated plate 8 can be disposed on the side of the cover 3. Sponge plate 2*d*, etc. can be used for the perforated plate 8. These are all embraced by the scope of the present invention.

I claim:

1. In a disposable dispenser carton for the simultaneous dispensing of flexible wrapping sheet materials and the foraminous perforation of selected portions thereof, the improvement comprising:

A. a blank of rigid foldable material, said blank having at least five parallel segments, which when folded laterally inwardly at right angles relative to each other form a carton of rectangular cross-section, one of said segments being in overlapping relation relative to a second said segment, the said one segment bearing plural projections in a preselected pattern and the said second segment of similar pattern defining means which are responsive to perforate action of the said projections of the said first segment therein for intermittent engagement by the projections in the alternate dispensing and perforation of the sheet material;

B. and means securing the respective folded segments into rigid position.

2. The dispenser of claim 1 wherein the said second segment defines corresponding plural perforations for engagement by the projections of the said first segment in the alternate dispensing and perforation of the sheet material.

3. The dispenser carton of claim 2 wherein the projections are conical in cross-section configuration.

4. The dispenser carton of claim 2 wherein the projections are pyramidal in cross-section configuration.

5. The dispenser carton of claim 1 wherein the said second segment defines a spongeous plate for engagement by the projections in the alternate dispensing and perforation of the sheet material.

6. The dispenser carton of claim 1 including vertical support plates extending from the second segment and at least one intermediate segment, said support plates being bent inwardly of the lateral folds of the segments whereby the plates overlie each other contiguously in endwise support of the carton.

7. The dispenser carton of claim 6 wherein the intermediate one segment adjacent the said second segment bears a cutter, said cutter extending above a plane of the said second segment when said second segment is positioned.

8. The dispenser carton of claim 6 wherein the said second segment carries a lateral extension which when bent laterally at right angles inwardly of said second segment defines a guide between said extension and a corresponding segment of the blank which is disposed substantially parallel and adjacent thereto, when folded in the formation of the carton.

* * * * *